United States Patent [19]

Cleveland

[11] 4,013,251

[45] Mar. 22, 1977

[54] PAINT CAN HOLDER

[76] Inventor: John P. Cleveland, 7074 Dover Way, Arvada, Colo. 80004

[22] Filed: Nov. 24, 1975

[21] Appl. No.: 634,677

[52] U.S. Cl. ..... 248/210; 248/310

[51] Int. Cl.[2] ..... E06C 7/14

[58] Field of Search ..... 248/210, 211, 238, 214, 248/215, 226 R, 226 C, 310, 339, 340

[56] References Cited

UNITED STATES PATENTS

| | | | |
|---|---|---|---|
| 1,297,435 | 3/1919 | Beck | 248/310 |
| 2,597,756 | 5/1952 | Sitek | 248/210 |
| 2,950,080 | 8/1960 | Glasgow | 248/210 |
| 3,642,239 | 2/1972 | Zeiler | 248/210 |
| 3,738,601 | 6/1973 | Gehringer | 248/210 |
| 3,829,051 | 8/1974 | Emmons | 248/238 |
| 3,895,772 | 7/1975 | Ellingson | 248/210 |

FOREIGN PATENTS OR APPLICATIONS

| | | | |
|---|---|---|---|
| 779,845 | 4/1935 | France | 248/210 |
| 70,766 | 11/1892 | Germany | 248/238 |
| 336,271 | 10/1930 | United Kingdom | 248/210 |

*Primary Examiner*—Lawrence J. Staab
*Attorney, Agent, or Firm*—C. B. Messenger

[57] ABSTRACT

A holder for paint cans and the like for engagement on extension and step ladders and other elevated work supports. A container receiving platform is held in horizontal position by demountable hook elements that may be attached at the rear of the platform to extend above or below the platform and by a telescoping brace arm that is pivotally engaged to the front of the platform and with a forked free end that is adapted for selective engagement to a lower rung of an extension ladder or for cooperative use with the hooks and a lock bar to hold the platform engaged to a flat step of a step ladder. The platform has a plurality of can receiving base edges or receptacles to receive and support cans of different size. The bottom rims of the cans are securely held by protrusions at least one of which is flexibly mounted to facilitate release of the cans from the platform. The platform, removable hooks, brace arm and lock bar are cooperatively designed for compact storage and shipment.

13 Claims, 12 Drawing Figures

76
83
30
71
73
78
77
49
48
72
15
20
32
31
26
25
27
28

15
30
38
26
20
32
76
47
73
35
25
39
28
31
A
27

76
73
71
48
72
15
20
34
26
29
25
27
33
32
31

76
83
30
71
73
72
48
15
20
26
25
28
32
27
31

PAINT CAN HOLDER

BACKGROUND OF THE INVENTION

A requirement to provide a support for paint cans or similar containers that are to be used at elevated work stations has long been recognized. Various types of support platforms have been provided as components of step ladders, and various attachments have likewise been designed for use with extension type ladders or for other use to hold containers at elevated positions. Where the platform is made a permanent part of the ladder construction, it is generally not movable to lower elevations, and, accordingly, an objective of providing a holder that is disposed at a convenient access position is not always satisfied. Previous attachments for holding liquid containers on ladders and the like have generally not been adapted for alternate usage on both extension and step type ladders, and further, little provision has previously been made for securing such attachments to elevated supports other than ladders.

Insofar as use on extension type ladders is concerned, the present invention seems most closely related to the type of holder presented in previous U.S. Pat. No. 3,738,601.

SUMMARY OF THE INVENTION

A preferred embodiment of the present invention provides a platform type of support that is adapted to receive paint containers that may alternately be of gallon, quart or liter size. Concentrically positioned base edges of the platform receive either the larger or smaller size cans, and protrusions or catches engage the lower rim of the cans to hold the container securely in place. Paired hooks that are separable from the platform can alternately be installed to extend above or below the platform depending on whether the holder is to be used on extension or step type ladders. For use on extension ladders, a brace arm extends from the forward or free end of the platform downwardly and inwardly toward a lower rung of the ladder. When used on step ladders, the hooks and brace arm extend below the supporting step, and they are interengaged one with the other through use of a lock bar to securely hold the platform in the desired position. The brace arm may be of telescoping type construction, and, accordingly, the platform can be securely held in a level position under circumstances where the distance between separate rungs of the ladder is not standard. The same telescoping extension feature for the brace arm makes it possible to support the can holder and platform in a position that is beneath the ladder if such position provides more convenient access for the workman. All of the components are cooperatively formed, shaped and designed to facilitate compact storage when not in use or when the item is being stored, shipped or displayed for sale.

DESCRIPTION OF THE PREFERRED EMBODIMENT

Figure 1:
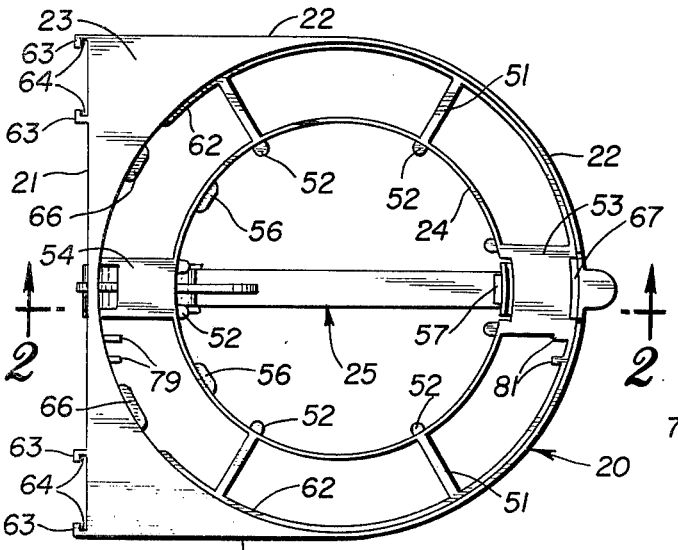
FIG. 1 is a top plan view showing details of the platform construction.
Figures 5, 6:
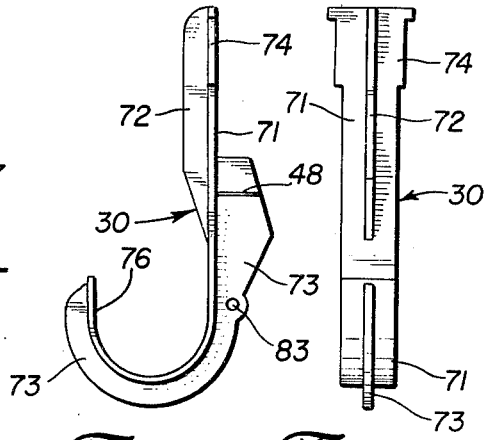
FIG. 5 is a side elevation of a hook element.
FIG. 6 is a front elevation of such hook.
Figure 2:
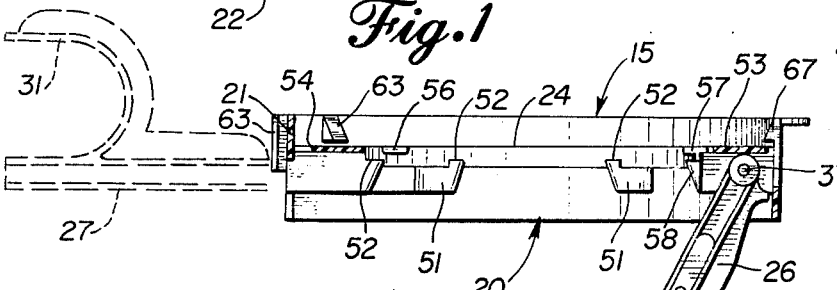
FIG. 2 is a side elevation showing the combination of platform and brace arm with the brace arm being shown in alternate positions.
Figures 9, 10, 11, 12:
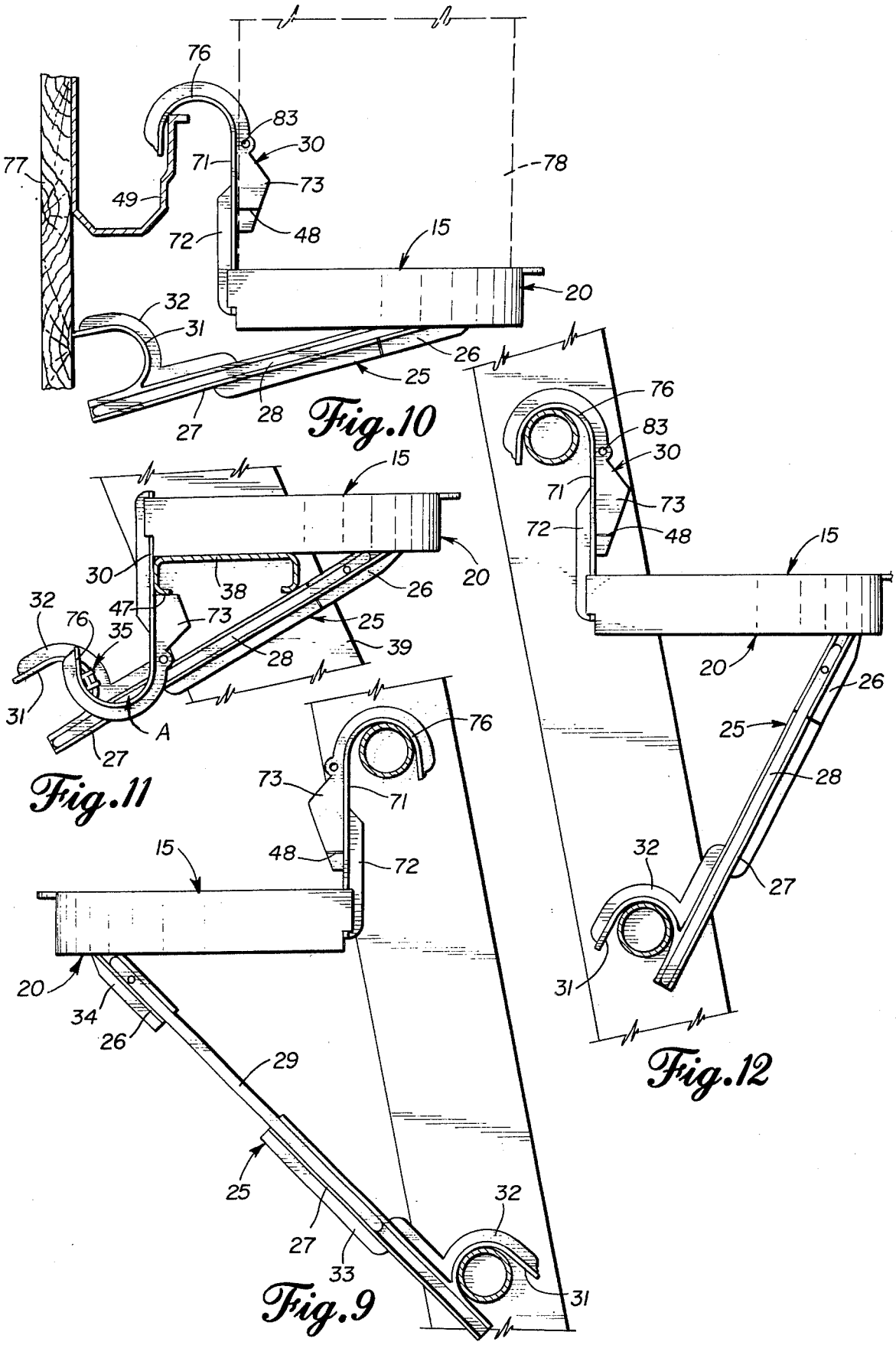
FIG. 9 is a side elevation showing the holder as used in an alternate position on an extension ladder.
FIG. 10 is a side elevation of the holder as used on the rain gutter of a house.
FIG. 11 is a side elevation showing the holder as engaged on the step of a step ladder.
FIG. 12 is a side elevation illustrating use of the paint can holder in a preferred position on an extension ladder.

A preferred embodiment of the invention is shown in the accompanying drawings, FIGS. 1 through 8 of which present details of construction for separate components. An entire paint can holder 15 is shown in assembled relation in FIG. 11. Such holder 15 includes a platform support 20, a brace arm 25, a pair of hooks 30 and a lock bar 35. Features and construction of such components and alternate uses thereof are shown in other Figures of the drawings. FIG. 1 shows details of the platform 15, while FIG. 2 shows the platform 20 in combination with a brace arm 25. The hook components 30 are alternately used in upstanding or inverted positions as shown in FIGS. 9 and 11.

Figure 4:
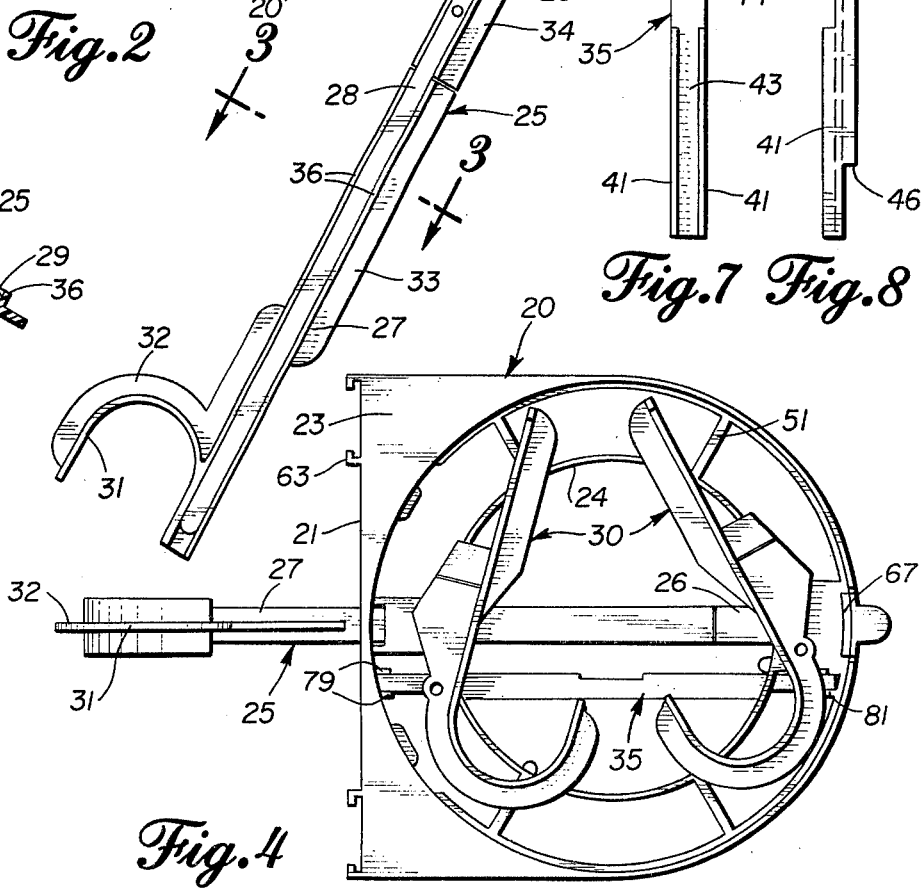
FIG. 4 is a top plan view showing components of the can holder device in stored position.

The platform 20, as best shown in FIGS. 1, 2 and 4, is of generally hollow type construction in which all of the structural components are of a relatively thin and near uniform thickness. The outer extremities of the platform are defined by a relatively straight face 21 that intersects a circumferential edge 22 and a platform top 23. The circumferential edge 22 continues outwardly from face 21, and it assumes a cylindrical shape that is of internal diameter somewhat corresponding to the size of a one gallon paint can. A base edge 24 of smaller diameter is disposed within the circumferential edge 22. The inner base edge 24 has an internal shape that substantially conforms to the outer diameter of the lower rim of a one quart or a one liter paint can. The inner base edge 24 is supported within circumferential edge 22 by a plurality of radially disposed diaphragm segments 51. The top limit of segments 51 are at a lower elevation than the top surface of edge 22 and at a level corresponding to the top limit for the base edge 24. The structure of diaphragm segments 51 extends inwardly of base edge 24 to provide can seating knobs 52 that are at an elevation below the top of diaphragm segments 51 and of base edge 24. A pivot support 53 is disposed at the outer or free end of platform 20, and a brace catch section 54 is disposed adjacent the inner face 21. Both the pivot support 53 and brace catch section 54 are below circumferential edge 22 and at a top limit or elevation corresponding to that of the inner base edge component 24. Protrusions 56 are disposed inwardly of the inner base edge 24 and at an elevation above the can seating knobs 52. Paired protrusions 56 at the rear of base edge 24 and a movable protrusion 57 mounted on pivot support 53 are positioned and formed to engage the upper surface of the lower rim of a quart or liter sized paint can when such can is sitting on the knobs 52. These fixed and movable protrusions 56 and 57 will be in secure engagement with the bottom can rim, and, accordingly, the paint can will be held downwardly and securely within the base edge 24 and against the seating knobs 52.

Actually liter and quart size paint cans and, in fact, all of the quart size cans of various manufacturers, do not have bottom rims of identical external diameter. Accordingly, the size of base edge 24 is regulated so that it will receive a wide variety of available containers. Since all the cans are not of identical size, the design, sizing and placement of the protrusions 56 and 57 are important. The non-moving protrusions 56 are preferably disposed on the structure of base edge 24 at positions away from the diaphragm segments 51 or the brace catch structure 54. At such positions the protrusions 56 can themselves be moved slightly when a can is being engaged or disengaged, since the base edge structure is relatively thin and is preferably molded of a resilient material. Desirably the protrusion 57 is free to move resiliently with respect to its support. To obtain such desirable movement or resilience, the protrusion 57 is attached to a supporting structure only along a single hinge edge 58. With this limited attachment and with the resilience of the molding material, the protrusion 57 may be moved outwardly away from a normal can engaging position when a can is to be removed from the platform support. Pressure directed outwardly on the can will cause movement of the protrusion 57 to an extent where the engagement with protrusions 56 is released.

The inner cylindrical wall provided by the circumferential edge 22 is continued inwardly toward the face 21 in order to provide a cylindrical receptacle for paint cans of larger size. Desirably the circumferential edge 22 and the inward extension thereof 62 provides a receptacle that is sized to closely receive and hold one gallon size containers. When such larger containers are to be supported, the bottoms thereof will be in contact with the top limits of base edge 24, diaphragm segments 51 and with the tops of pivot support 53 and brace catch section 54. In order to hold these larger cans in position, protrusions 66 are provided at positions adjacent the face 21. Again, a movable protrusion 67 is provided adjacent the outer or free end of platform 20. These protrusions again engage the upper surface of the lower rim for larger sized containers and similarly serve to hold the bottoms of the cans securely in place within circumferential edge 22 and downwardly against the supporting platform provided by inner base edge 24 and its diaphragm supports 51, etc.

At the lateral sides of platform 20 and on face 21 paired extensions 63 provide a channel or T lock catch 64 adapted to receive and hold a cooperatively formed lock section 74 of the hooks 30. Lock sections 74 are of slightly wider construction than the main cross bar frame 71 for the hooks 30. A reinforcing rib 72 extends from the lock section 74 along an inwardly disposed surface of the hooks, and a similar rib reinforcement 73 extends externally of the hooks adjacent hook ends 76. The cross bar frame 71 bends to provide hook end 76 with this hook end being of a size to engage the rungs of ladders. For the preferred embodiment of the invention, the platform 20 and the hooks 30 and most other components of the holder 15 are all formed of a resilient type plastic, such as polypropylene. Accordingly, the outer limits of lock section 74 and the limiting surfaces for catch 64 can each be formed with straight parallel sides with an interference fit and the resilience of the materials providing a tight and secure interengagement of the hooks and platform components. For other materials it would potentially be desirable to provide a slight taper for the lock section 74 so that it could be securely engaged in upright or inverted positions in a catch section 64 that itself had only straight or parallel sides.

Figure 3:
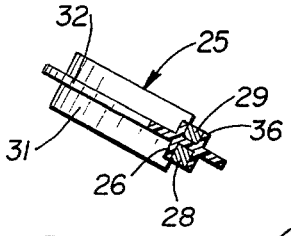
FIG. 3 is a cross-sectional view taken along the line 3—3 of FIG. 2.

The cooperative interworking arrangement for the platform 20 and the brace arm 25 is most fully shown in FIG. 2 with FIG. 3 providing additional details of construction for the brace arm 25 itself. In the preferred embodiment the brace arm 25 is of three-component construction with a pivot section 26, a hook end 27 and paired extension bars 28 and 29. The hook end 27 is forked at its outer end to provide a ladder rung engagement component 31 of substantially U shaped section. The hook end 27 is provided with reinforcing webs 32 and 33, while the pivot section 26 has a reinforcing web 34. The extension bars 28 and 29 are received in dovetail shaped channels 36 provided in lateral sides of the brace arms when the components are molded. Extension bars 28 and 29 which are made of metal or a more rigid type of plastic have a cooperating cross section that is securely received in the dovetail channels 36. With this arrangement the hook end 27 may be extended away from the pivot section 26, and, accordingly, the effective length from the ladder rung engaging forked end 31 to the pivot 37, which secures the brace arm 25 to the platform 20, may be changed. This extension feature is especially advantageous where ladders of non-standard configuration are to be used. For example, if ladders having a rung spacing of, say, fourteen inches are encountered in place of the usual twelve-inch spacing, the length of the brace arm 25 can be changed, and the platform 20 will still be held in the desired flat level position illustrated in FIG. 12. Alternately, the extension feature can also be used to provide support for a paint can or other container that is to be supported in a beneath-the-ladder position as illustrated in FIG. 9. An extended length for the brace arm 25 will be required when liquid containers are to be suspended in this position even when ladders having standard rung spacing intervals are being used.

Figures 7, 8:
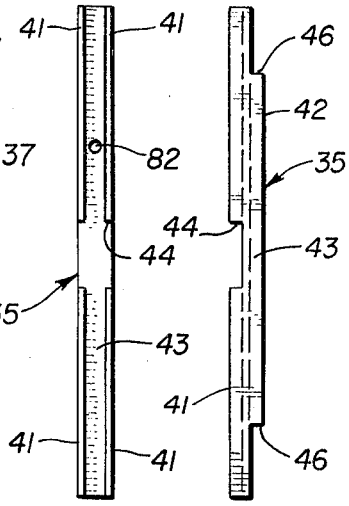
FIG. 7 is a bottom view of a lock bar component.
FIG. 8 is a side view of such lock bar.

In addition to providing a paint can holder 15 that is useful to hold cans when extension type ladders are being used, the present holder 15 can be used for similar support of paint cans when step ladders are being used. When the holder 15 is to be used on step ladders, the hooks 30 will be inserted in the platform 20 in an inverted position as shown in FIG. 11. The platform can be positioned at any step 38 of a step ladder 39. The brace arm 25 is still positioned below the platform 20, but the U shaped end 31 thereof is disposed in position of alignment with respect to the hook ends 76 for the support hooks 30. A lock bar 35 of structure as shown in FIGS. 7 and 8 is engaged between the hook ends 76 of hooks 30 and the U shaped forked end 31 for the brace arm 25. Lock bars 35 have reinforcing flanges 41 and 42 that extend on opposite sides of a center web section 43. The flanges 41 are interrupted at the center of the lock bar to provide a notch 44 adapted to engage the U shaped forked end 31 of the brace arm 25, while the flanges 42 are terminated inwardly of the ends of the lock bar 35 to provide shoulders 46 that are adapted to engage the cross frame 71 of the hooks 30. If the steps 38 are of narrower vertical section than the step 38 illustrated, the lock bar 35 may be inserted alternately at a position A indicated in FIG. 11. Insertion at this alternate position will, of course, raise the brace arm 25 so that it will snugly engage a thinner step. Since all step ladders do not have steps of the same thickness, this alternate positioning for the lock bar 35 is advantageous. The use of polypropylene plastic materials is also advantageous, since these materials are quite flexible, and the brace arm can be bent to assure a tight fitting engagement. Further, since the steps of step ladders are not of uniform thickness, it is contemplated that the reinforcing rib 73 on the hooks 30 can be cut away by the individual users to provide a truncated edge 47 that will closely engage the lower surface of a step ladder step 38. This rib 73 could actually be provided with a score line 48, as shown in FIG. 12, to facilitate the breaking away of a part thereof if it is determined to be required in usage and if enough ladders are found to have steps of the same thickness.

In addition to the illustrated uses on step ladders and extension ladders, it has been found that the construction for the holder 15 can also provide support for paint cans when the holder is engaged to various building components. In FIG. 10 the hooks 30 are engaged to a rain gutter 49 of a house. The forked end 31 of the brace arm 25 is disposed against a fascia board 77 of the house, and the platform support 20 is held in flat level position so that a can of paint 78 will be supported closely adjacent to work being accomplished. If an extension type brace arm is provided, the brace arm can be extended or retracted to engage various other elevated supports, and, accordingly, the multiple uses for the holder 15 are increased.

FIG. 4 illustrates the convenient packaging and storing features of the device. When the device is being stored between periods of use or when it is packaged for shipment or sale, the hook ends 30 are placed within the platform 20 to be supported by the inner base edge 24 and the diaphragms 51, etc. Preferably, receptacles 79 and 81 are provided by the platform 20 to receive and hold the ends of the lock bar 35. The receptacles 79 and 81 are below the inner base edge 24, and lock bar 35 can, accordingly, be maintained in this position at all times when it is not being used. The lock bar 35 does have a hole 82 through the web section 43 through which a string or wire may be attached to avoid any potential loss thereof. Similarly, the hook ends 30 are provided with holes 83 that may be used for the same purpose. Since the holder 15 may be collapsed to a relatively flat configuration as shown in FIG. 4, the pivot interconnecting the platform 20 and brace arm 25 will usually be secured in place. Customer assembly then requires only the installation of the hooks 30 in their alternate upright or inverted positions depending on the customer's first use. The flat or collapsed configuration is well adapted to shipping and merchandising operations, since the holders 15 can be packaged in individual see-through bags for bulk shipment in standard cartons.

I claim:

1. A holder for selective use with liter, quart and gallon size paint cans and the like to hold said cans in level position adjacent elevated user work stations comprising a platform support having an inwardly disposed support face, an inner base edge disposed on said platform and inclusive of means for selectively receive and support the lower rim of liter or quart size cans with the top limit of said inner base edge being positioned to provide support for the bottom of gallon size cans disposed on said platform, a lock element on said platform support adjacent the said support face, a hook component for engagement with said lock element to selectively extend above or below said platform, a brace arm attached to said platform support outwardly from the support face thereof for extension beneath said platform to provide outrigger support for an otherwise free end of said platform, said hook and brace arm being adapted for cooperative use to hold said platform and any cans disposed thereon at elevated positions for convenient use with said holder when configured for use on step ladders having said hook disposed below said platform and, accordingly, on the same side thereof as said brace arm, and means for cooperatively interengaging said hook and brace arm to hold the brace arm engaged with the bottom of a step of said ladder whereby said platform and cans held thereby are secured to the ladder step and ladder.

2. The holder as set forth in claim 1 wherein said means for interengaging comprises a lock bar for selective dispositions interengaging said hook and brace arm.

3. The holder as set forth in claim 2 and further comprising receptacles provided by said platform at the bottom surface thereof for the reception and storage of said lock bar.

4. The holder as set forth in claim 2 and further comprising a forked end for said brace arm with said lock bar engaging said hook and the forked end of said brace arm.

5. The holder as set forth in claim 2 wherein a plurality of hooks are provided for selective engagement to said platform with at least two of said hooks extending below the platform and with said lock bar interengaging a plurality of hooks and said brace arm.

6. The holder as set forth in claim 5 and further comprising a forked end for said brace arm with said lock bar engaging a plurality of hooks and the forked end of said brace arm.

7. The holder as set forth in claim 1 wherein said platform is of open construction with said inner base edge being of open ring configuration and further comprising a circumferential edge on said platform disposed outwardly of said inner base edge, said circumferential edge being of a size adapted to surround and receive the lower rim of gallon size paint cans, diaphragm segments interconnecting said circumferential edge and said ring formed inner base edge with the top edge of said diaphragm segments being disposed adjacent the top limit of said inner base edge for the support of said gallon size cans, said inner base edge and said circumferential edge being formed of resilient material that is deformed as said cans are applied and removed whereby said cans are securely held.

8. The holder as set forth in claim 7 wherein said means for supporting comprises can seating elements disposed beneath the top limits of said inner base edge and inwardly thereof to provide support for the bottom of liter and quart size cans disposed within said inner base edge.

9. The holder as set forth in claim 8 and further comprising a plurality of rim protrusions disposed on said inner base edge in position above said can seating elements for engaging the upper surface of the lower rim of liter and quart size cans to hold the cans securely on said can seating elements.

10. The holder as set forth in claim 9 wherein at least one of said inner base edge rim protrusions is movable to facilitate placement and removal of said quart and liter size cans.

11. The holder as set forth in claim 10 wherein said platform support inclusive of said inner base edge and movable rim protrusion is formed unitarily of flexible plastic material to facilitate placement and removal of said cans.

12. The holder as set forth in claim 7 and further comprising a plurality of protrusions disposed on said platform in position above said inner base edge and outwardly with respect thereto for engaging the upper surface of the lower rim of gallon size cans to hold the cans securely to said platform with at least one of said protrusions being movable to facilitate placement and removal of said cans with all of said platform inclusive of the circumferential edge, the inner base edge, the diaphragm segments, and protrusions being formed unitarily of flexible plastic material with the resilience of said material facilitating placement and removal of cans received by said platform.

13. The holder as set forth in claim 12 wherein a plurality of rim protrusions for said inner base edge are disposed in positions intermediate said diaphragm segments whereby these said rim protrusions are themselves movable due to the resilience of said plastics material and the placement of said rim protrusions.

* * * * *